US005713106A

United States Patent [19]

Dämmig

[11] Patent Number: 5,713,106

[45] Date of Patent: Feb. 3, 1998

[54] PROCESS TO ENSURE PRECISE AUTOLEVELLING FOR THE DRAFTING OF A FIBER SLIVER IN A PRE-SPINNING MACHINE AND DEVICE TO CARRY OUT THE PROCESS

[75] Inventor: Joachim Dämmig, Ingolstadt, Germany

[73] Assignee: Rieter Ingolstadt Spinnereimaschinenbau AG, Ingolstadt, Germany

[21] Appl. No.: 694,902

[22] Filed: Aug. 9, 1996

[30] Foreign Application Priority Data

Aug. 12, 1995 [DE] Germany ..... 195 29 753.9

[51] Int. Cl.[6] ..... D01H 5/38

[52] U.S. Cl. ..... 19/240; 19/23; 364/470.14

[58] Field of Search ..... 19/23, 236, 237, 19/239, 240, 260; 364/470.01, 470.13, 470.14

[56] References Cited

U.S. PATENT DOCUMENTS

| | | | |
|---|---|---|---|
| 4,369,550 | 1/1983 | Meile | 19/240 |
| 4,812,993 | 3/1989 | Konig et al. . | |
| 5,003,668 | 4/1991 | Meyer . | |
| 5,438,733 | 8/1995 | Melcher et al. . | |
| 5,463,556 | 10/1995 | Denz | 364/470 |
| 5,583,781 | 12/1996 | Denz et al. | 364/470.01 |

FOREIGN PATENT DOCUMENTS

| | | |
|---|---|---|
| 2650287C2 | 5/1978 | Germany . |
| 3406389A1 | 8/1985 | Germany . |
| 3801880C2 | 8/1989 | Germany . |
| 2151811 | 9/1984 | United Kingdom . |

OTHER PUBLICATIONS

New Regulating Concept for Short–Staple Spinning, Melliand Textilberichte, Feb. 1985, Dipl.Ing W. Friebel und Dr.Ing. Burkhard Wulfhorst.

Modern Machines for Preparatory Operations for Spinning, Melliand Textilberichte, Dec. 1985.

Drawframe Prospectus With Translation.

*Primary Examiner*—Michael A. Neas

*Attorney, Agent, or Firm*—Dority & Manning

[57] ABSTRACT

The invention relates to a process to ensure precise autolevelling for the drafting of a fiber structure in a pre-spinning machine, whereby an open control circuit controls the drafting of the fiber sliver through the drafting rollers, whereby the fiber structure is clampingly held between drafting roller pairs and sensing roller pair during stoppage, whereby a pulse generator is able to produce impulses for the rotation of a pair of sensing rollers which are transmitted to an electronic memory during stoppage of the drafting equipment, and whereby the association of data and momentary position of the sliver events is maintained in the electronic memory during stoppage of the drafting equipment.

During stoppage each impulse of the pulse generator is detected and evaluated by means of an electronic system (13, 15, 23) on the connection between pulse generator (4, 14, 19, 22) and electronic memory (3, 18, 26).

12 Claims, 4 Drawing Sheets

PROCESS TO ENSURE PRECISE AUTOLEVELLING FOR THE DRAFTING OF A FIBER SLIVER IN A PRE-SPINNING MACHINE AND DEVICE TO CARRY OUT THE PROCESS

BACKGROUND OF THE INVENTION

The present invention relates to a process to ensure precise autolevelling for the drafting of a fiber sliver of a pre-spinning machine, whereby an open autolevelling circuit controls the drafting of the fiber structure through drafting rollers. The fiber structure is clamped between drafting roller pairs and a sensing roller pair when the drafting equipment is stopped. A pulse generator is able to produce impulses for the rotation of the sensing roller pair which are transmitted to an electronic memory when the drafting equipment is stopped and whereby the association of the data with the current position of sliver events is maintained in the electronic memory when the drafting equipment is stopped.

A pre-spinning machine in the textile industry may be a combing machine, card, or draw frame in the present case, in which a fiber sliver is drafted by means of the drafting rollers which are installed in the drafting system. Autolevelling of drafting in the drafting system is effected by means of an open control circuit, whereby, as a rule, a pair of sensing rollers is provided before the drafting equipment as an element measuring the thickness of the fiber sliver. The term "fiber structure" shall be used hereinafter. It includes fiber sliver as well as fiber fleece.

The Prospectus Draw Frame SB51, Draw Frame SB52, Autoleveller draw frame RSB51 of Schubert & Salzer Maschinenfabrik AG of August 1988, in the illustration on page 8 shows an electronic autolevelling system for the drafting of textile fiber slivers with the drafting equipment of a draw frame. This drafting equipment consists of three pairs of rollers, one input roller pair, one central roller pair and one delivery roller pair. Input and central roller pairs are mechanically coupled to a pair of sensing rollers. An autolevelling motor is connected with its shaft via a planetary gear to the central roller pair. The control motor can be controlled so that it is able to modify the rotational speed of the pairs of sensing rollers, input rollers and delivery rollers relative to the rotational speed of the pair of delivery rollers. Drafting of the fiber sliver is accomplished by changing the rotational speed of the input and central roller pairs relative to the delivery roller pair. The central roller pair and the delivery roller pair constitute the main drafting zone in which the fiber sliver is drafted. The drafting point of the fiber sliver is located in this main drafting zone. The pair of sensing rollers (measuring element) installed before the input into the drafting equipment determines the thickness of the entering fiber sliver. This is the measuring location. A pulse generator is mechanically coupled to the pair of sensing rollers. The illustration on page 89 of the above-mentioned prospectus shows the basic possibility of autolevelling drafting in drafting equipment by means of an open control circuit. Similarly, autolevelling of a fiber fleece can be carried out in a pre-spinning machine such as a card, for example.

There also exists an embodiment in the state of the art in which a measuring element (measuring hopper) functioning in a capacitive manner is used. The capacitive measuring hopper supplies measuring signals concerning the thickness of the fiber sliver to an electronic memory. Separate from the capacitive measuring hopper, a tachometer is coupled to a pair of conveying rollers to convey or draw in the fiber sliver. The tachometer functions as a pulse generator. The tachometer transmits clocking impulses to the electronic memory as the entering fiber sliver moves. This embodiment with measuring elements functioning in a capacitive manner changes nothing in the functioning of the following electronic memory or changes nothing in the functioning of the open control circuit.

The electronic memory as a further component of the open control circuit finally determines the amount of autolevelling for the autolevelling motor. As the drafting equipment is stopped, the stored data is preserved in the electronic memory, i.e. the association of the data with the current position of the sliver events is stored. Sliver events are individual thicknesses of the fiber sliver. These stored data are used to run up the drafting equipment again at the end of stoppage and to again deliver the fiber sliver. Stoppage is understood to be halted delivery of the fiber sliver, i.e. the drafting equipment is stopped. During such stoppage, the stretched fiber structure is located between the measuring element and the drafting equipment rollers. Supply voltage for all components of the machine is available.

The reasons for such stoppage may be necessary machine maintenance work or machine functions.

It has been found that when the drafting equipment starts up again from the machine-caused stoppage, wrong drafting of a relatively long fiber sliver occurs. It has been found that under the effect of the fiber sliver located between the pairs of rollers (which tends to decrease its drafting tension), the roller pairs, and in particular the pair of sensing rollers or the tachometer, can rotate in an uncontrolled and uncontrollable manner. This effect occurring during stoppage is furthered by the release of tension in the means transmitting force to the drafting equipment rollers. One result of stoppage is that the pair of sensing rollers may rotate slightly backwards, in the opposite direction of their operating direction. This occurs when no additional stopping means are provided. Since the pair of sensing rollers is connected to the input and central roller pair, the sensing roller pair is always included in a reverse rotation in case of stoppage.

Because of the reverse rotation of the pair of sensing rollers during stoppage, the pulse generator may generate unacceptable impulses since it is coupled to the sensing roller. Although no fiber sliver transportation results, the pulse generator transmits an impulse to the electronic memory. The position indicator for the storage of the electronic memory is thus repositioned with the stoppage of the machine (drafting equipment). This results in asynchronicity of the association between the different fiber sliver thicknesses and the corresponding generation of measuring signals (data) in storage of the electronic memory. The measuring signals (data) of sliver thickness stored during stoppage are therefore transmitted at the wrong time to the control device of the autolevelling motor as the pair of sensing rollers or the drafting equipment is started up again. This has a detrimental effect on the drafting of the fiber sliver.

OBJECTS AND SUMMARY OF THE INVENTION

It is a principal object of the invention to correct the error caused as a result of a stoppage of a pair of rollers with pulse generator required by the machine or the operation for an open control circuit of the drafting equipment of a pre-spinning machine. Additional objects and advantages of the invention will be set forth in part in the following description, or may be obvious from the description, or may be learned through practice of the invention.

During stoppage of the drafting equipment, an electronic system on the connection between the pulse generator and the electronic memory acquires and evaluates every impulse of the pulse generator. The electronic system evaluates two output channels of a digital pulse generator. The two output channels supply phase-shifted rectangular impulses as the shaft of the digital pulse generator rotates. In another embodiment, two designs are possible. In one embodiment of the invention the evaluation of an impulse by the electronic system is designed so that retransmission by the electronic system of the jitter to the electronic memory is locked. This is a jitter lock-out. A jitter is the unstable flank of an impulse. A jitter is produced when the grid-marked impulse disk of the digital pulse generator stops so that sensing takes place in the border area of a marking change. A jitter can only occur on one of the two output channels of the pulse generator, and only if the pulse generator rotates slightly forward, or backward in case of machine vibration for instance, when the tension of the fiber sliver and drive belt is released. In the evaluation, a jitter is recognized on an output channel of the pulse generator and is suppressed. The electronic system may be a jitter lock-out if it is formed at least by one flip-flop or a software simulation (computing program). The suppression or lock-out of an unacceptable impulse against the electronic memory effectively avoids the possibility of data for autolevelling points stored in the electronic memory being falsified during stoppage. Immediately upon restarting the drafting equipment, precise autolevelling points become possible.

In another embodiment of the invention an evaluation of an impulse is provided for which produces a signal for the electronic memory (storage) as the impulse is retransmitted by the electronic system, so that the position indicator there is controlled in the storage area of the electronic memory. Control consists in the position indicator to be reset by the signal of the electronic system in the addressing of storage locations in the FIFO memory. The functioning principle of a FIFO memory is known as first in, first out. Depending on the number of reverse impulses, the position indicator is set back in addressing. This makes it possible for errors caused by somewhat further reversal (more than in case of a jitter) of the pulse generator are also corrected for the autolevelling application points in the FIFO memory.

The device according to the invention has provided for an electronic system in the connection between pulse generator and electronic memory. There, the electronic system is used to carry out the process. The electronic system may consists of at least a flip-flop or a software simulation (computing program).

In another embodiment, the electronic system may be a forward-backward rotation recognition (directional discriminator) with position correction in the storage of the electronic memory.

The electronic system according to the invention as a jitter lock-out or recognizer of direction in back and forward rotation with position correction in the storage of the electronic memory was not previously known in drafting equipment of pre-spinning machines. It represents an effective solution which is able, at lower cost, to replace the previous utilization of a mechanically acting return lock-out, at least for the roller pair with impulse generator.

Application of the invention is also possible when separate drives (principle of electrical wave) are used on the drafting equipment.

Examples of embodiments of the invention are shown in drawings and are described below in further detail.

DETAILED DESCRIPTION OF THE PREFERRED EMBODIMENTS

Figure 1:
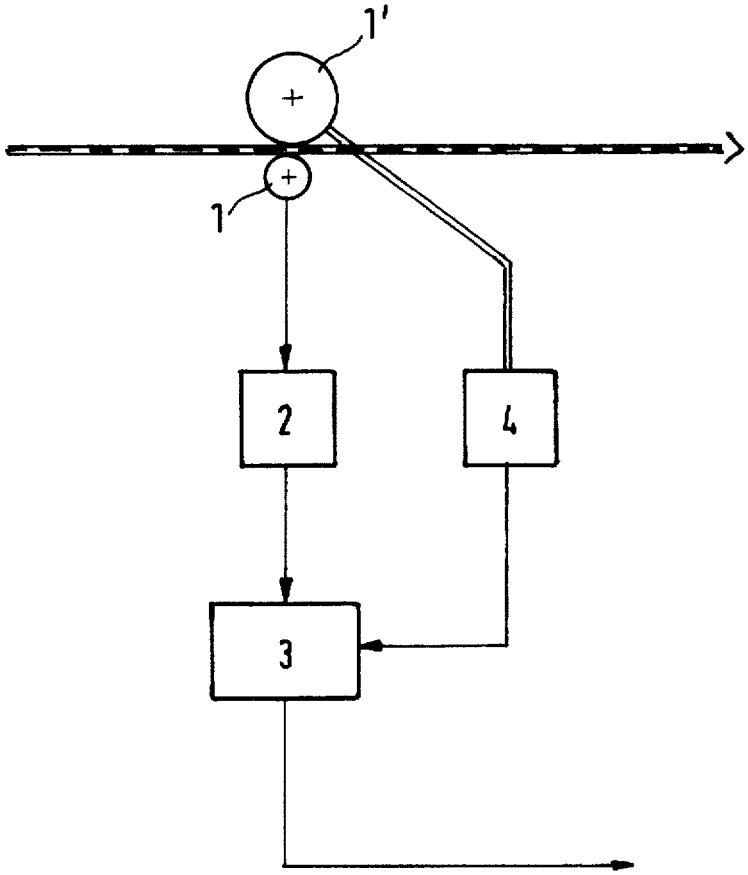
FIG. 1 shows a measuring element with pulse generator and electronic memory as a detail of an open control circuit.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield still a further embodiment. It is intended that the present invention cover such modifications and variations.

FIG. 1 shows a detail of the open control circuit with the measuring element. The measuring element is a pair of sensing rollers 1, 1'. The stroke of the movable sensing roller 1 which is produced by the fiber structure thickness is converted into an electronic signal in the signal converter 2. As a rule, an analog/digital transformer is used in combination with the signal converter. In addition, a signal connection to the electronic memory 3 is provided. An additional input to the electronic memory constitutes the output of a pulse generator. The pulse generator 4 is coupled mechanically to the pair of sensing rollers 1, 1'.

A digital pulse generator with two output channels is used as the pulse generator 4. Using a digital pulse generator becomes possible when other components of the open control circuit are equipped as digitally functioning components. A digital pulse generator also becomes necessary in order to regulate the drive precisely at rotational speeds close to stoppage. This digital pulse generator supplies clocking impulses (called impulses) as a function of the speed of the entering fiber structure, so that e.g. every 3 mm of fiber structure length covered, a measuring signal indicating the fiber sliver thickness is sensed by the pair of sensing rollers. Fiber structure may be fiber sliver or fiber fleece.

The position indicator simulated by a software is steered by the supplied clocking pulses of the impulse generator to the current position in the storage of the electronic memory. The position of the position indicator relative to a corresponding storage address determines the read-out of a corresponding measuring signal at a control device and at the same time the reading in of a current measuring signal from the pair of sensing rollers. Finally the reading out and reading in of the measuring signals corresponding to the fiber sliver thickness relative to the storage is controlled in accordance to these clocking pulses.

The measuring signals are time-delayed in the storage of the electronic memory. The electronic memory ensures that a necessary drafting change related to a corresponding sliver thickness and the measuring signal produced by the latter occurs with delay precisely at the moment when the corresponding sliver thickness is located in the main drafting zone, i.e. at the drafting point. The further processing of the measuring signal in a control device may produce a change of rotational speed of the autolevelling motor, resulting in a change in drafting.

The length of the storage in the electronic memory is an image of the distance between the measuring point (pair of sensing rollers) and the drafting point (in the main drafting zone between roller pairs 7,7' and 8,8'). The storage length is therefore also the sum of the partial distance covered by a rotating pair of sensing rollers between each clocking pulse in order to fill out the path between measuring point and drafting point.

The FIFO storage of the electronic memory is organized so that it simulates a known FIFO principle. FIFO means first in, first out, i.e. the measuring signals of the sliver thickness managed in the storage are processed so that the one which has longest been in storage is taken from it first. The storage time, i.e. the delay time of a measuring signal is exactly equal to the time required by a position indicator in order to process the current data length (FIFO length) in the FIFO storage.

A digital pulse generator produces a rotation of its impulse disk when its shaft is rotated. The impulse disk is marked on its circumference and constitutes a grid. This could be a light/dark grid for example. Scanning of this grid is without contact with two channels e.g. according to the optical transmitted light principle. At the output of the digital pulse generator, each of the two output channels produces rectangular impulses which are phase-shifted relative to each other.

When the pair of sensing rollers stops, the impulse disk can come to a standstill in such a manner that scanning is positioned in the border area of a marking change. At the output of the impulse generator this state can be recognized in that a flank or several impulse flanks (jitter) are produced in an output channel. By turning back the pair of sensing rollers during stoppage, a state change between the two levels of an impulse is brought about.

A jitter is the instable flank of an impulse. Therefore a clocking impulse is produced which goes to the electronic memory for further processing. This jitter produces the disadvantage described in the state of the art. On one of the two output channels, impulses would be produced which would change the position of the position indicator within the storage. This produces errors in autolevelling points of the controls.

Figure 2:
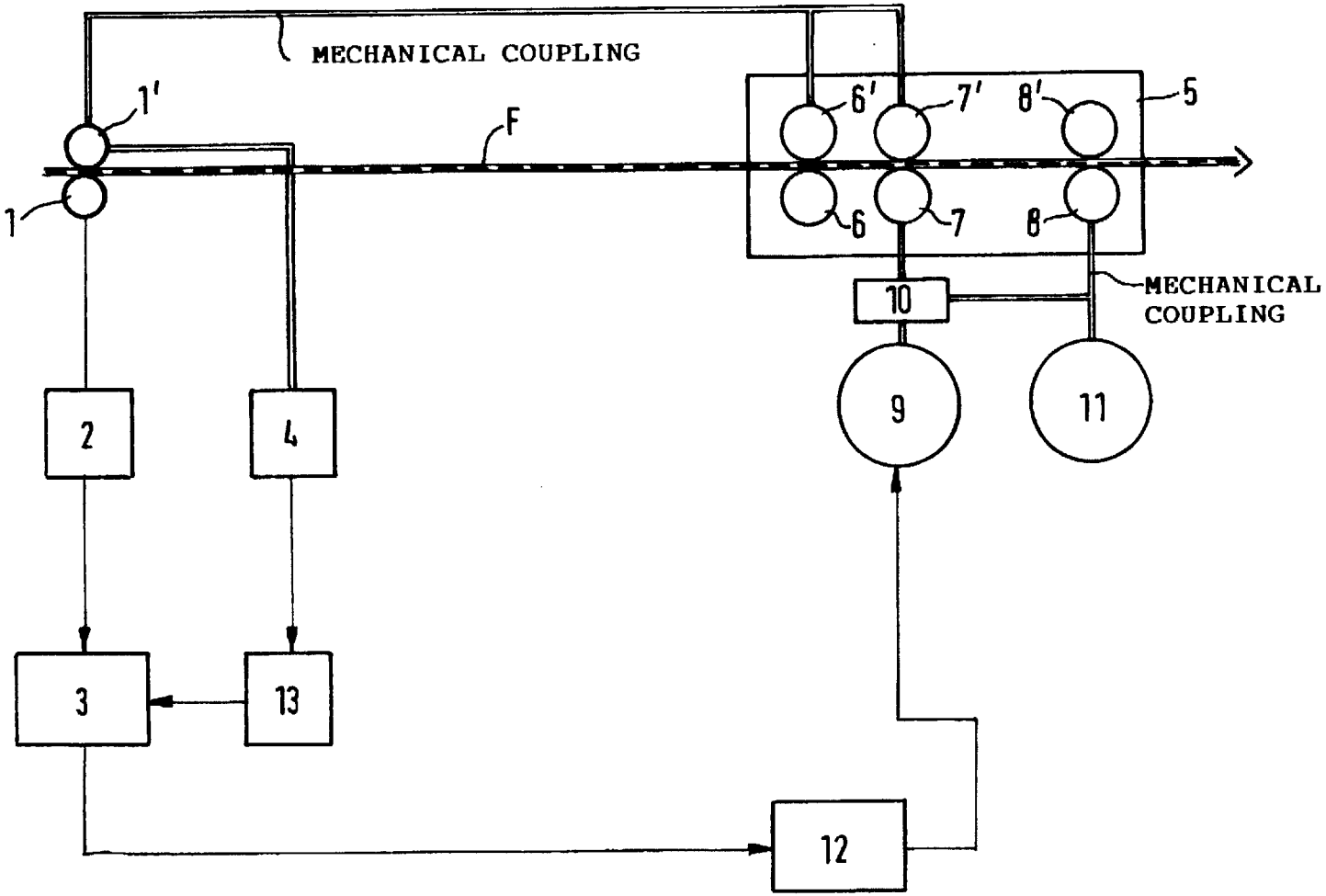
FIG. 2 is a representation of an electronic system between pulse generator and electronic memory in the open control circuit of a drafting equipment.

According to the process of the invention, every impulse of the pulse generator is detected and evaluated on the connection between pulse generator and electronic memory by means of an electronic device during stoppage of the drafting equipment. This situation is shown in FIG. 2. Based on FIG. 1, FIG. 2 shows the pair of sensing rollers 1, 1', the signal converter 2, the pulse generator 4 and the electronic memory 3. Furthermore can be recognized: drafting equipment 5 consisting of the pair of input rollers 6, 6', the pair of central rollers 7, 7' and the pair of delivery rollers 8, 8'. Between the pair of sensing rollers 1, 1' and the drafting equipment 5 is a fiber structure F, in the present example a fiber sliver, under tension. The pair of input rollers 6, 6', the pair of central rollers 7, 7' and the pair of sensing rollers 1, 1' are mechanically connected to each other. The pair of central rollers 7, 7' is furthermore connected to the autolevelling motor 9 via a planetary gear 10. A main motor 11 provides the drive of the pair of delivery rollers 8, 8' and is also connected to the planetary gear 10.

The open control circuit is connected from the output of the electronic memory 3 to controls 12 which are able to act upon the autolevelling motor 9. The controls 12 may comprise a desired-value step and a control device (see also cited draw frame from the prospectus, page 8).

According to the process of the invention, an electronic system 13 which detects and evaluates every impulse is installed on the line connection between pulse generator 4 and electronic memory 3.

Figure 3:
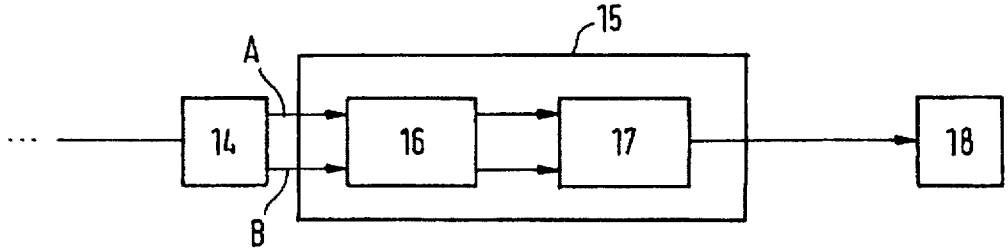
FIG. 3 shows an electronic system as jitter lock-out.

In one embodiment of the process, the electronic system 13 is able to prevent retransmission of the impulse to the electronic memory 3. This is a jitter lock. This is possible if the electronic system 13 has at least one flip-flop or an equivalent software simulation (computing program). An example of such an electronic system is shown in FIG. 3. FIG. 3 explains the basic structure of an electronic system to lock out the impulse going from the digital pulse generator 4 to the electronic memory 3, i.e. the structure of a jitter lock.

A digital pulse generator 14 supplies rectangular impulses resulting from the rotation on two output channels, channel A and channel B. The rectangular impulses are supplied phase-offset because of the structure of the incremental pulse generator 14. The rectangular impulses are transmitted to an electronic system 15. This electronic system 15 consists of at least one signal processor 16 and an RS flip-flop 17. The signal processor 16 serves for logical linking of the signals of channels A and B in order to suppress unacceptable level conditions at the input of the RS flip-flop. The RS flip-flop ensures that a jitter of a channel produced during stoppage is suppressed, i.e. locked out, and is not transmitted to the electronic memory 18.

Figure 4:
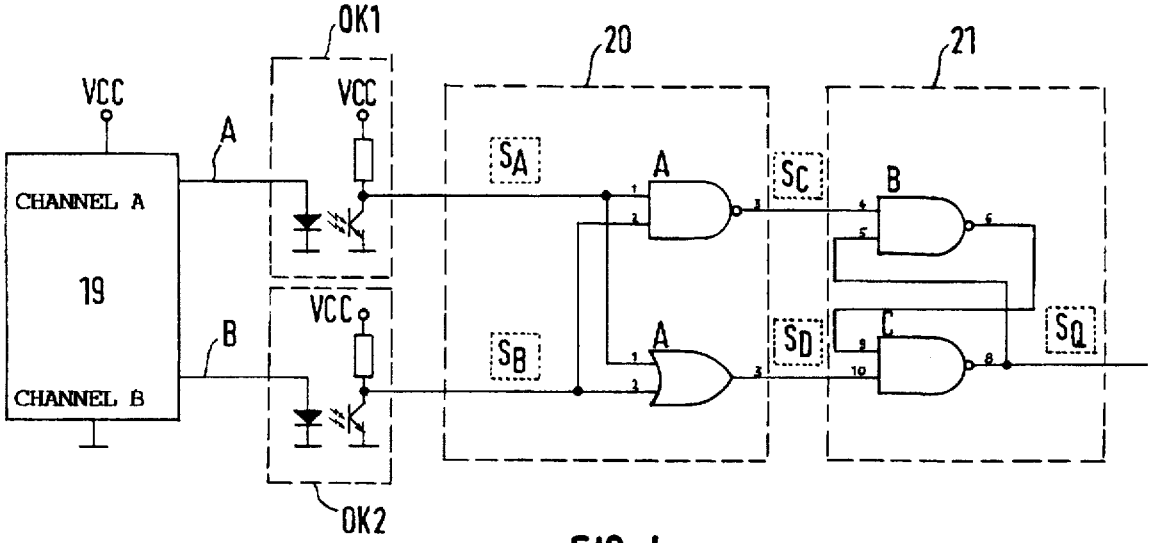
FIG. 4 shows the structure of a jitter lock-out.
Figure 5:
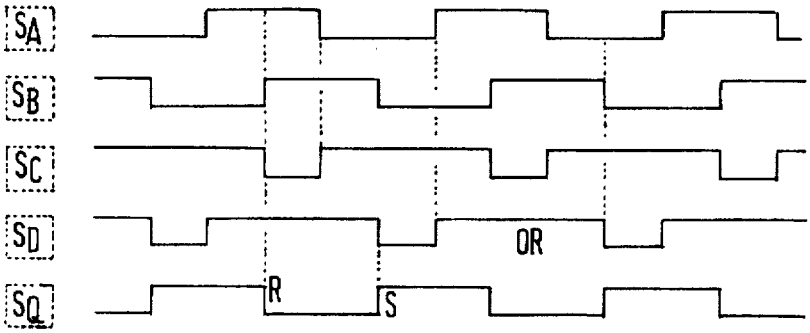
FIG. 5 shows a signal indication for the jitter lock-out of FIG. 4.

FIG. 4 shows a possible, detailed embodiment of FIG. 3. A digital pulse generator 19 supplies phase-offset rectangular impulses on both output channels A,B. These impulses are transmitted by optical-electronic couplers OK1, OK2 to a signal processor 20. The signal processor 20 is formed by a NAND element and an OR element. The impulses are retransmitted by the signal processor 20 to a NAND-RS flip-flop 21. This flip-flop consists of two NAND elements. The output of the flip-flop constitutes a signal line. The individual signal conditions in the signal processor 20 and the flip-flop 21 are represented by $S_A$, $S_B$, $S_C$, $S_D$, $S_Q$. A suitable signal indication of this is shown in FIG. 5.

The flanks of the impulses of channels A and B are evaluated by means of this electronic system according to FIG. 4. If the electronic system is at least a flip-flop, it is possible to ensure that jitters are locked out during stoppage of the machine.

In another embodiment, the electronic system can produce a signal which moves a position indicator of the FIFO storage forward and backward. The electronic system is a recognizer of the direction of rotation. The rectangular impulses are evaluated on both output channels of a digital pulse generator in direction of rotation.

Figure 6:
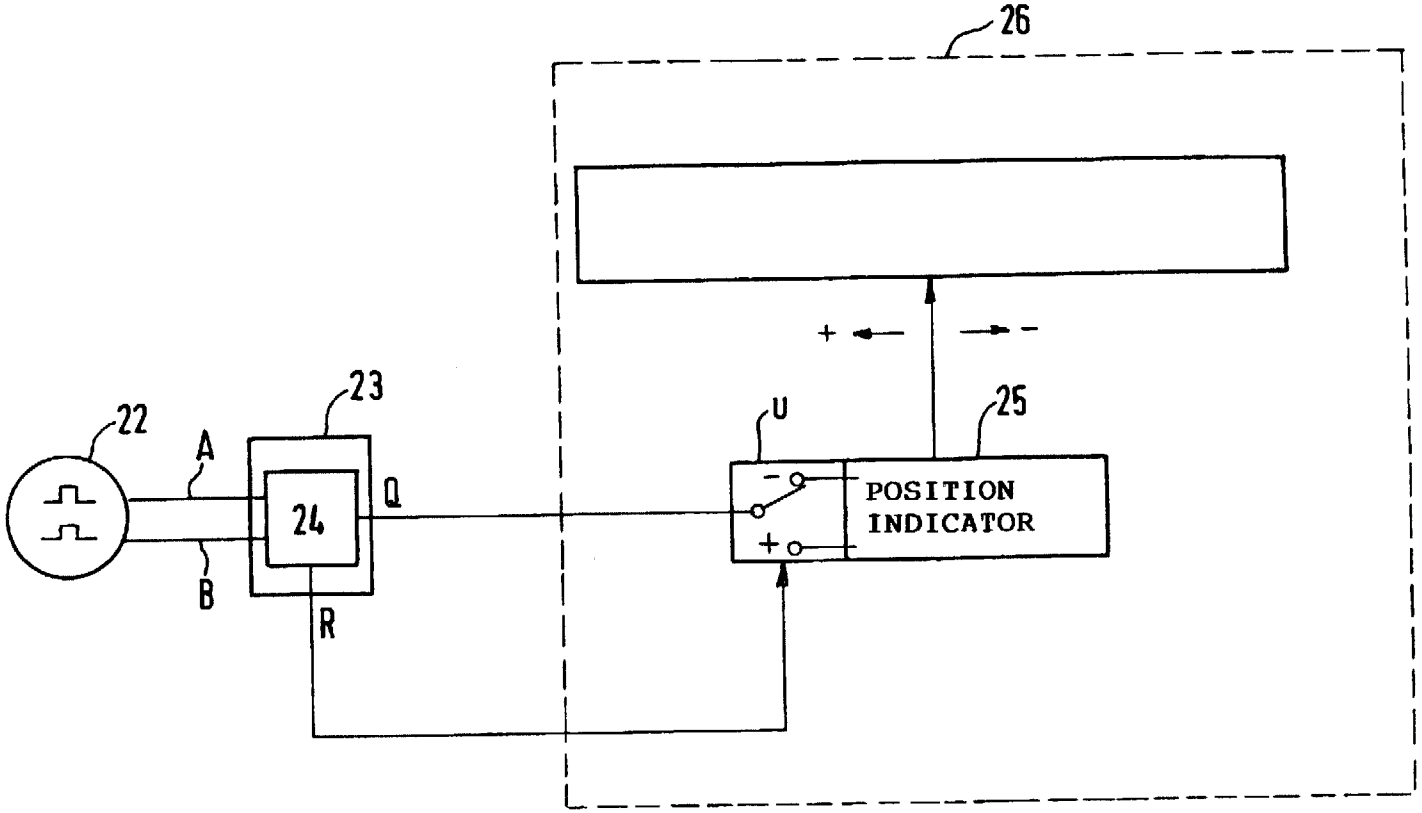
FIG. 6 shows an electronic system as a recognition device for direction of rotation.

FIG. 6 shows the principle of recognition of direction of rotation with directional evaluation. A digital pulse generator 22 supplies its phase-offset rectangular impulses on two output channels A,B to an electronic system 23. The level sequence indicates a direction of rotation. The electronic system 23 consists essentially of a logical link, a directional discriminator 24 which first of all derives the direction of rotation from the sequence of flanks. When a reversal of direction of rotation is detected by the directional discriminator 24, a switch-over U of the counting direction of the FIFO pointer 25 (position indicator) formed in a software takes place via counting direction R, i.e. the signal Q is switched over by switch-over in counting direction (defined as reverse rotation). This electronic system 23 is connected to an electronic memory 26. The electronic system 23 moves the position pointer 25 in the addressing in the FIFO storage as far back as is made necessary by the number of unacceptable reverse signals. This electronic system 23 is able to evaluate during stoppage of the pair of sensing rollers 1, 1' more than one signal resulting from reverse rotation for the correction of the autolevelling events. Thus the error concerning the autolevelling application points provoked by the reverse rotation of the pair of sensing rollers is corrected.

It will be apparent to those skilled in the art that various modifications and variations can be made in the present invention without departing from the scope and spirit of the invention. It is intended that the present invention cover such modifications as come within the scope of the appended claims and their equivalents.

I claim:

1. A process for autolevelling drafting of a fiber structure in drafting equipment of a pre-spinning machine wherein an open control circuit controls the drafting of the fiber structure and the fiber structure is clampingly held between drafting roller pairs and a pair of sensing rollers during stoppage of the drafting equipment, the drafting equipment including a pulse generator operably connected to the sensing rollers for producing impulses corresponding to the rotational speed of the sensing rollers, the impulses used for synchronizing storage of fiber structure thickness data in an electronic memory, said process comprising:

maintaining storage of fiber structure thickness data related to the fiber structure at the stopped position in the electronic memory during stoppage of the drafting equipment;

detecting each impulse generated by the impulse generator during stoppage before the impulses can effect storage of the fiber structure thickness data in the electronic memory; and evaluating the detected impulses and adjusting storage of the fiber structure thickness data in the electronic memory during stoppage depending on said evaluation so that upon subsequent restarting of said drafting the correct stored fiber structure thickness data is retrieved from the electronic memory and sent to the control circuit at the appropriate time for drafting of the corresponding fiber structure.

2. The process as in claim 1, including generating two output channels with the impulse generator and evaluating both of the output channels.

3. The process as in claim 1, including detecting a jitter condition during said evaluation and blocking transmission of jitter impulses to the electronic memory.

4. The process as in claim 3, further comprising detecting the jitter condition at an output channel of the pulse generator.

5. The process as in claim 1, including generating a control signal from said evaluation and using the control signal to control position of an electronic storage position indicator in the electronic memory.

6. The process as in claim 1, wherein said detecting and said evaluating are done by an electronic system interfaced operably between the impulse generator and electronic memory.

7. The process as in claim 1, wherein said detecting and said evaluating are done by a computer simulation program.

8. A system for autolevelling drafting of a fiber structure, comprising:

pairs of drafting rollers defining a drafting zone therebetween wherein said fiber structure is drafted;

a pair of sensing rollers disposed to sense thickness variations in said fiber structure before said fiber structure is conveyed to said drafting zone;

a control circuit configured to automatically control said drafting rollers to draft thickness variations in said fiber structure sensed by said sensing rollers;

said control circuit further comprising an electronic memory for storing fiber structure thickness data sensed by said sensing rollers until said sensed fiber structure is conveyed to said drafting zone, and an impulse generator operably connected to said sensing rollers to generate pulses for synchronizing storage of said fiber structure thickness data in said electronic memory with the speed of said drafting and sensing rollers; and an electronic system operably disposed to detect and evaluate pulses generated by said impulse generator during stoppage of said system and to control storage of said fiber structure thickness data during said stoppage based on said detected and evaluated pulses so that upon subsequent restarting of said system said fiber structure thickness data stored during said stoppage is retrieved at the correct time the respective sensed fiber structure is conveyed to said drafting zone.

9. The system as in claim 8, wherein said electronic system further comprises means for detecting jitter pulses generated by said impulse generator during said stoppage.

10. The system as in claim 8, wherein said electronic system comprises at least one flip-flop.

11. The system as in claim 8, wherein said electronic system comprises a directional discriminator.

12. The system as in claim 8, wherein said electronic system comprises a simulation computer program.

* * * * *